US009147984B2

(12) United States Patent
Brookshire et al.

(10) Patent No.: US 9,147,984 B2
(45) Date of Patent: Sep. 29, 2015

(54) POWER DEVICE HAVING ROTATING OUTLET UNIT

(75) Inventors: Kyle David Brookshire, Belmont, MA (US); Meng-Chang Liu, Puli Township, Nantou County (TW); Chuanwu Li, Malden, MA (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 44 days.

(21) Appl. No.: 14/004,964

(22) PCT Filed: Mar. 15, 2011 (Under 37 CFR 1.47)

(86) PCT No.: PCT/CN2011/071808

§ 371 (c)(1), (2), (4) Date: Apr. 17, 2014

(87) PCT Pub. No.: WO2012/122702

PCT Pub. Date: Sep. 20, 2012

(65) Prior Publication Data

US 2015/0079810 A1 Mar. 19, 2015

(51) Int. Cl.

| | |
|---|---|
| ***H01R 39/00*** | (2006.01) |
| ***H01R 25/00*** | (2006.01) |
| ***H01R 35/04*** | (2006.01) |
| ***H01R 13/502*** | (2006.01) |
| *H01R 103/00* | (2006.01) |
| *H01R 24/78* | (2011.01) |

(52) U.S. Cl.

CPC ..... *H01R 25/003* (2013.01); *H01R 13/502* (2013.01); *H01R 35/04* (2013.01); *H01R 24/78* (2013.01); *H01R 25/006* (2013.01); *H01R 2103/00* (2013.01)

(58) Field of Classification Search

CPC .... H01R 25/003; H01R 35/04; H01R 13/502; H01R 25/006; H01R 24/78

USPC ..... 439/31

See application file for complete search history.

(56) References Cited

U.S. PATENT DOCUMENTS

| | | | | |
|---|---|---|---|---|
| 6,642,450 | B1 | 11/2003 | Hsiao | |
| 6,750,410 | B2 * | 6/2004 | Lee | 200/51.03 |
| 7,771,239 | B1 | 8/2010 | Hsiao | |

(Continued)

FOREIGN PATENT DOCUMENTS

| | | | |
|---|---|---|---|
| CN | 2886878 | Y | 4/2007 |
| CN | 2886879 | Y | 4/2007 |
| JP | 2005056758 | A | 3/2005 |

OTHER PUBLICATIONS

Supplementary European Search Report from corresponding European Application EP 11861088 dated Jul. 11, 2014.

(Continued)

*Primary Examiner* — Jean F Duverne

(74) *Attorney, Agent, or Firm* — Lando & Anastasi LLP

(57) ABSTRACT

A power device (10) includes a housing (12), a power input interface provided on the housing, and a rotating outlet unit (30) coupled to the housing. The rotating outlet unit has a plurality of power outlets (38) to distribute power from the power input interface. The rotating outlet unit is configured to rotate between a first position in which the power outlets are disposed on one side of the housing and a second position in which the power outlets are disposed on another side of the housing. A method for providing power to electrical components is further disclosed.

16 Claims, 6 Drawing Sheets

(56) References Cited

U.S. PATENT DOCUMENTS

| | | | | |
|---|---|---|---|---|
| 8,283,802 | B2 * | 10/2012 | Jansma et al. | 307/23 |
| 2002/0195324 | A1 | 12/2002 | Lee | |
| 2004/0209500 | A1 | 10/2004 | Chang | |

OTHER PUBLICATIONS

International Search Report and Written Opinion from corresponding PCT/CN2011/071808 dated Sep. 1, 2011.

* cited by examiner

POWER DEVICE HAVING ROTATING OUTLET UNIT

This application is a National Stage Application under 35 U.S.C. §371 from PCT/CN2011/071808, filed Mar. 15, 2011, which is hereby incorporated by reference in its entirety for all purposes.

BACKGROUND OF THE INVENTION

1. Field of Disclosure

Embodiments of the disclosure relate generally to power devices, and more specifically to a power device, such as a power strip and a surge protector, having a rotating outlet unit to provide access along two sides of the device.

2. Discussion of Related Art

Many electronic and electrical systems, such as computer and home entertainment systems require that electrical power be supplied to various components of the system. The use of power devices, such as power strips and surge protectors to supply power is known.

A power strip is a strip of power outlets that receive power from a power source and allow multiple electronic devices to be plugged into the various outlets on the power strip to distribute that power. In some instances, the power strip has housing provided with the outlets and a flexible cable with a plug attached at the end of the cable. The plug is configured to be engaged into a power source, such as a wall outlet. In addition to providing power to the devices, the power strip may also provide power surge protection.

For various applications, whether for indoor or outdoor usage, desktop or wall environments, a user of a power strip may encounter a problem in which the power outlets of the power strip are oriented incorrectly for the particular usage or environment. Specifically, the user will have difficulty inserting a plug into the power outlet of the power strip.

BRIEF SUMMARY OF THE INVENTION

An aspect of the present disclosure is directed to a power device comprising a housing, a power input interface to the housing, and a rotating outlet unit coupled to the housing. The rotating outlet unit has a plurality of power outlets to distribute power from the power input. The rotating outlet unit is configured to rotate between a first position in which the power outlets are disposed on one side of the housing and a second position in which the power outlets are disposed on another side of the housing.

Embodiments of the power device further comprise configuring the rotating outlet unit to have a casing and a rotary socket element provided at one end of the casing. The rotary socket element is fixed with respect to the casing and rotatably coupled to the housing to enable rotation of the casing with respect to the housing. The casing includes a surface having the plurality of power outlets. The surface is co-planar with the sides of the housing when configuring the rotating outlet unit in the first position and the second position. The plurality of outlets when located in the second position are disposed perpendicular to the plurality of outlets in the first position. The rotary socket element includes a hollow interior to enable cables to pass from the housing to the casing of the rotating outlet unit. The housing and the casing include at least one protrusion provided on one of the housing and the casing and at least two dimples provided on the other of the housing and the casing. The at least one dimple is configured to be seated in one of the at least two dimples when positioned in the first and second positions. The housing and the casing include several protrusions and dimples that are symmetrically positioned on their respective housing and casing. In certain embodiments, the power device is a surge protector, a power conditioner, a power strip or a battery.

Another aspect of the disclosure is directed to a method of providing power to an electronic device. In one embodiment, the method comprises: providing a power device including a housing, a power input interface to the housing, and a rotating outlet unit coupled to the housing. The rotating outlet unit has a plurality of power outlets to distribute power from the power input. The rotating outlet unit is configured to rotate between a first position in which the power outlets are disposed on one side of the housing and a second position in which the power outlets are disposed on another side of the housing. The method further comprises rotating the rotating outlet unit to one of the first position and the second position to locate the plurality of outlets on a desired side of the housing.

Embodiments of the method further include positioning at least one protrusion provided on one of the housing and the rotating outlet unit into one of at least two dimples provided on the other of the housing and the rotating outlet unit. The at least one dimple is configured to be seated in one of the at least two dimples when rotated between the first and second positions. The rotating outlet unit includes a surface having the plurality of power outlets. The surface is co-planar with the sides of the housing when positioning the rotating outlet unit in the first position and the second position. The plurality of outlets in the second position are disposed perpendicular to the plurality of outlets in the first position.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the invention. In the figures:

DETAILED DESCRIPTION OF THE INVENTION

Figure 1:
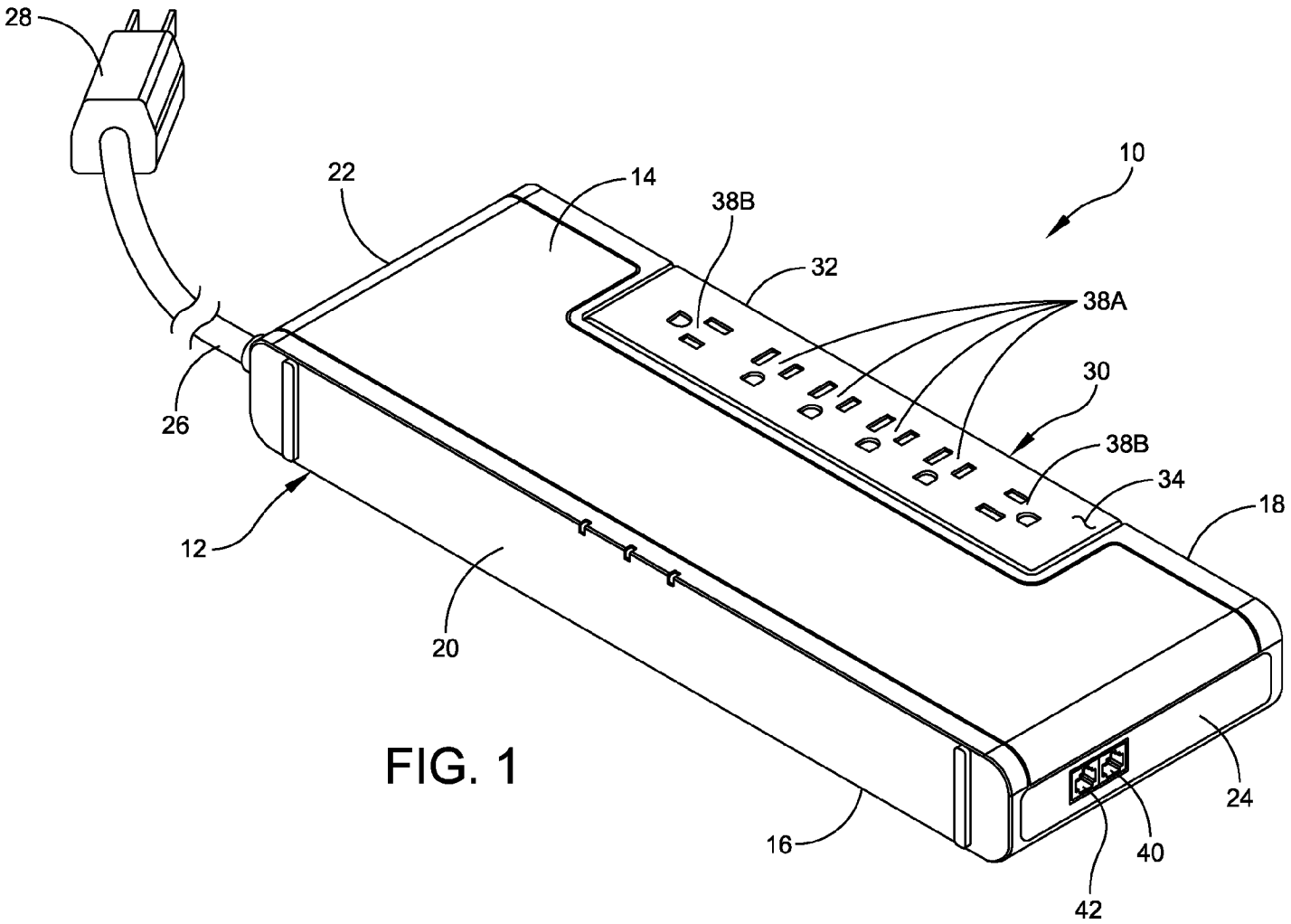
FIG. 1 is a rear perspective view of a power device of an embodiment of the disclosure.

It is to be appreciated that embodiments of the systems and methods discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Embodiments of the present disclosure are directed to a power device, e.g., a power strip or a surge protector, that is configured to position or otherwise locate power outlets associated with the power device on one of two surfaces of the power device. In one embodiment, the power device includes a generally rectangular-shaped housing and a power input interface to the housing. In a certain embodiment, the power input interface is a power cord having a plug that is capable of being inserted into a power source, such as a wall outlet. The power device further includes a rotating outlet unit that is coupled to the housing and has a plurality of power outlets that distribute power from the power input. The rotating outlet unit is configured to rotate between a first position in which the power outlets are disposed along one side of the housing, e.g., the top surface of the housing, and a second position in which the power outlets are disposed on an adjacent side of the housing, e.g., a long side of the housing. This construction enables a user of the power device to access the power outlets in one of two positions, which makes it more convenient to access in environments in which space is a premium.

Figure 2:
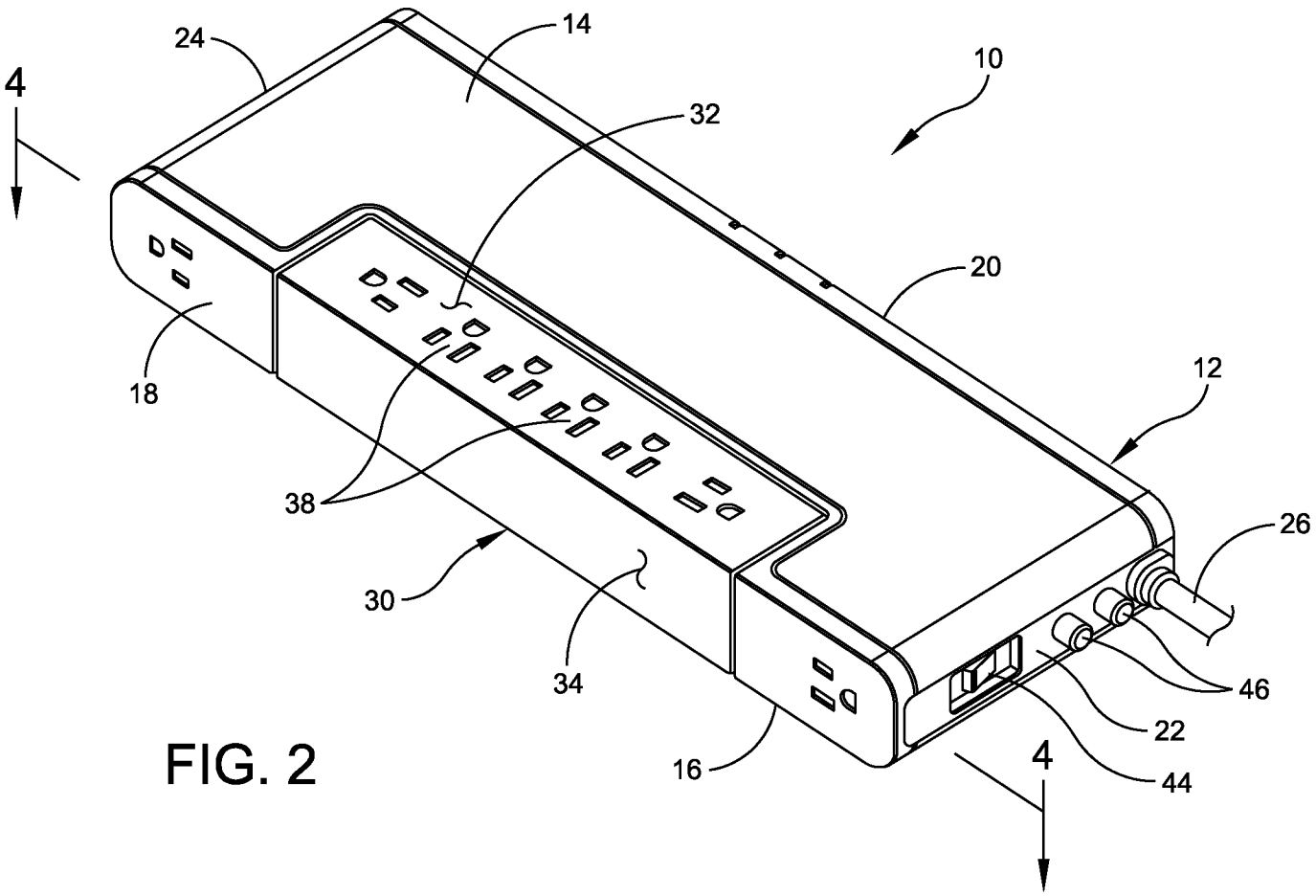
FIG. 2 is a front perspective view of the power device with a rotating outlet unit disposed on one side of the device.
Figure 3:
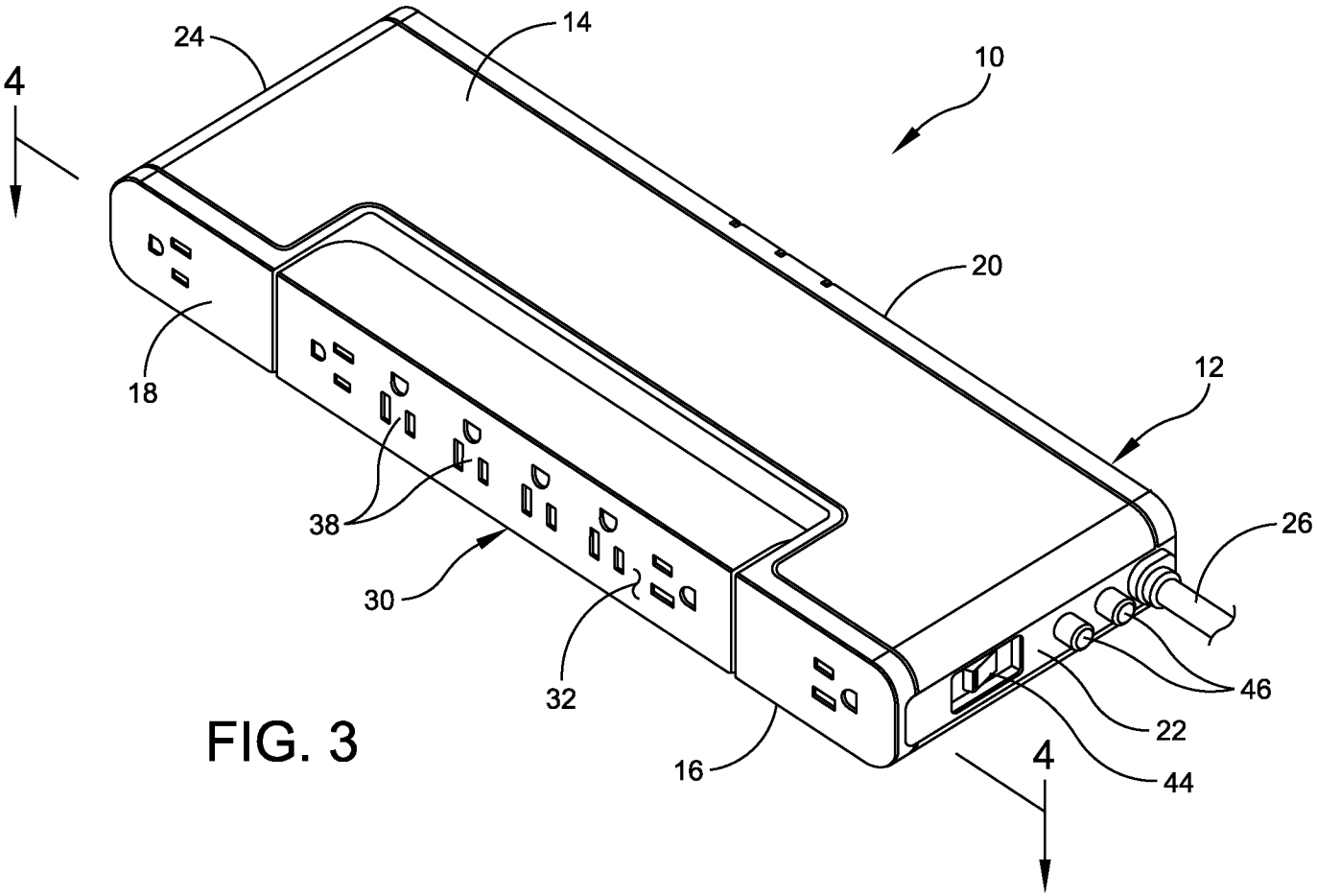
FIG. 3 is a front perspective view of the power device with the rotating outlet unit disposed on an adjacent side of the device.

Turning now to the drawings, and more particularly to FIGS. 1-3, an embodiment of the present disclosure includes a power device, such as a power strip or a surge protector, which is generally indicated at 10. The power device 10 includes a rectangular-shaped housing, generally indicated at 12, having a top 14, a bottom 16, a front side 18, a back side 20, and two opposite ends 22, 24. A power input embodying a cable 26 having a plug 28 is provided on one end 22 of the housing 12 of the power device 10, which can be inserted into a typical wall outlet (not shown). The housing 12 is configured to support components of the power device, which may include components to condition power and the associated wiring. The cable 26 and the plug 28 serve as a power input interface for the power device 10.

The power device 10 further includes a rotating outlet unit, generally indicated at 30, which is pivotally secured to the housing 12 in the manner described below. The rotating outlet unit 30 has an elongate casing 32 having two primary surfaces 34, 36. As shown, one of the surfaces 34 of the casing 32 has a plurality of outlets (e.g., six), each indicated at 38. In the shown embodiment, the four inboard outlets 38A (FIG. 1) are oriented in one direction while the two outboard outlets 38B (FIG. 1) are oriented in a direction perpendicular to the direction of the inboard four outlets. One end 24 of the housing 12 of the power device 10 has a coaxial input port 40 and a coaxial output port 42 that may be used to provide surge protection through data lines, for example. The other end 22 of the housing further has a power switch 44 and LED indicators, each indicated at 46.

The arrangement is such that the rotating outlet unit 30 is capable of being rotated between a first position in which the power outlets 38 are disposed along the top 14 of the housing 12 of the power unit 10 and a second position in which the power outlets are disposed along an adjacent side 18 of the housing. The rotating outlet unit 30 is positioned with respect to the housing 12 along side 18 of the housing. It should be understood that the housing 12 may be designed so that the rotating outlet unit 30 is disposed along any side or end of the housing in a manner consistent with the principles taught herein. Also, more than one rotating outlet unit 30 may be provided. As shown, FIG. 2 illustrates the power outlets 38 positioned on the top surface 14 of the housing 12 of the power unit 10. FIG. 3 illustrates the power outlets 38 positioned on an adjacent side surface 18 of the housing 12 of the power device 10. As will be described in greater detail below, a certain amount of resistance or friction is provided when moving the rotating outlet unit 30 between its first and second positions. Thus, once positioned in either the first position or the second position, the rotating outlet unit 30 remains in the desired position until physically rotated by the user to the other position.

Figure 4:
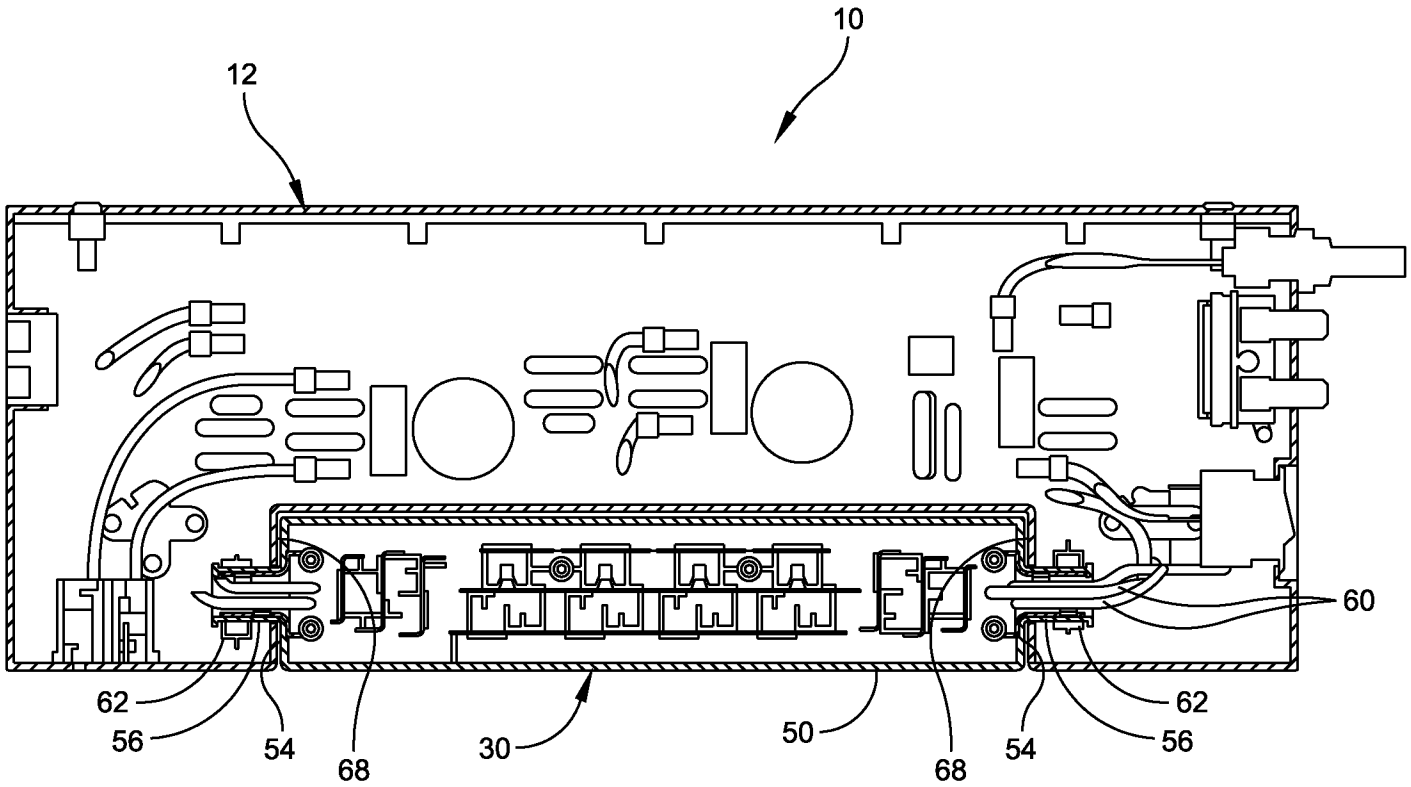
FIG. 4 is a cross-sectional view taken along line 4-4 of FIG. 2.
Figure 5:
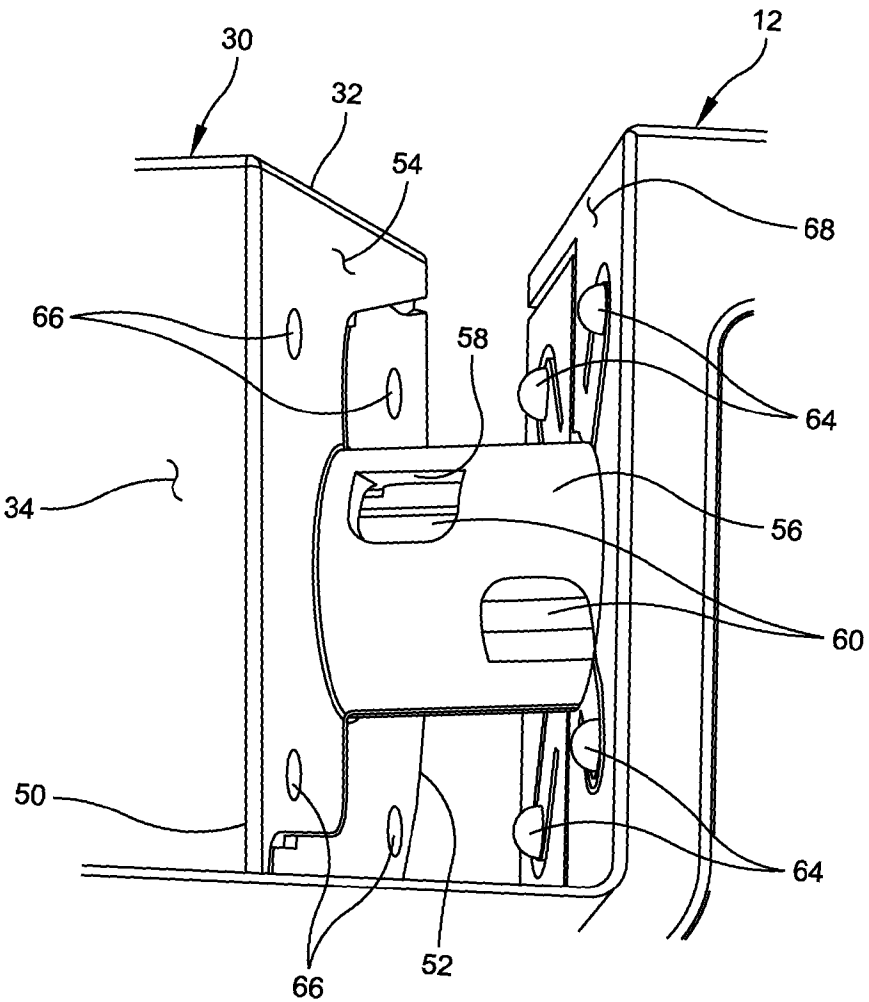
FIG. 5 is an enlarged perspective view of a rotary socket element of the power device in an exaggerated, spaced-apart configuration.

In addition to FIGS. 1-3, reference is made to FIGS. 4 and 5, which illustrate the component parts enabling the rotation of the rotating outlet unit 30 with respect to the housing 12 of the power device 10. The rotating outlet unit 30 includes a casing 50 having the first surface 32 and the second surface 34, which is perpendicular to the first surface. The casing also includes a curved surface 52 (FIG. 5) that connects opposite sides of the first surface 32 and the second surface 34. The casing 50 further includes opposite ends (end surface 54 in FIG. 5), which are both rotatably connected to the housing 12 in the manner described below. As shown, the first surface 32 includes the power outlets 38 along a length of the surface whereas the second surface 34 is solid along the length of the surface. It should be noted that the second surface 34 may include the power outlets 38 instead of the first surface 32.

Each end 54 of the casing 50 of the rotating outlet unit 30 further includes a rotary socket element 56, which is fixedly connected to the end surface 54 of the casing 50. The rotary socket element 56 includes a hollow interior 58 that enables wires 60 to extend between the interior of the housing 12 to the interior of the casing 50 thereby providing power to the power outlets 38. The rotary socket element 56 is rotatably secured to the housing 12 to enable the rotation of the casing 50 with respect to the housing 12. In one embodiment, a retainer structure 62 is provided to secure the rotary socket element 56 axially in place while enabling the rotation of the rotary socket element with respect to the housing 12. In another embodiment, a bearing (not shown) may be provided in place of the retainer structure 62. The result is that the rotary socket elements 56 provided at the ends of the casing 50 allow the rotation of the casing 50 with respect to the housing 12.

With particular reference to FIG. 5, a plurality of protrusions, each indicated at 64, and dimples, each indicated at 66, are provided to secure casing 50 of the rotating outlet unit 30 in the first position and the second position. The protrusions 64 and the dimples 66 also provide a certain amount of friction between the casing 50 and the housing 12 when rotating the rotating outlet unit 30 between the first and second positions. As shown, the protrusions 64 are provided on the housing 12 of the power device 10 and the dimples are provided on the end surface 54 of the casing 50 of the rotating outlet unit 30. The protrusions 64 are spring-loaded so that each protrusion extends beyond a surface 68 provided on the housing 12. Thus, when a force, such as a force provided by the end 54 of the casing 50 of the rotating outlet unit 30, is exerted on the protrusion 64, the protrusion retracts within a recess (not designated) provided in the surface. FIG. 5 illustrates one end 54 of the casing 30 configured with dimples 66 that receive protrusions 64 provided on the housing 12. The other end of the casing 50 and the associated housing 12 may be similarly configured. As shown, four protrusions 64 and four dimples 66 are symmetrically positioned on their respective housing 12 and casing 50. It should be understood that any number of protrusions 64 and dimples 66 may be positioned symmetrically on their respective housing 12 and casing 50 to achieve the desired movement of the rotating outlet unit 30 between the first and second positions.

Figure 6:
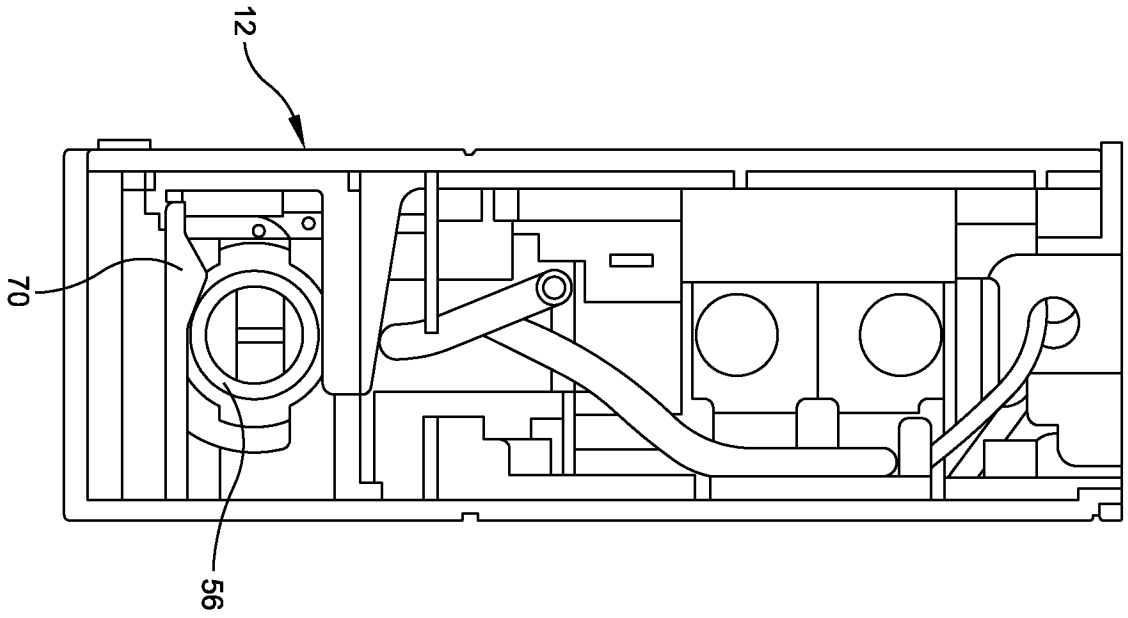
FIG. 6 is a cross-sectional view of the rotary socket element.

During operation, when the casing 50 of the rotating outlet unit 30 and the housing 12 are in the first position illustrated in FIG. 2, the power outlets 38 are disposed along the top surface 14 of the housing. In this position, for each end of the casing 50 of the rotating outlet unit 30, the protrusions 64 of the housing 12 are seated within the dimples 66 of the casing 50. In another embodiment, the protrusions 64 may be provided on the casing 50 and the dimples 66 may be provided on the housing 12. To move the rotating outlet unit 30 to the second position, a user rotates the casing 50 of the rotating outlet unit ninety degrees so that the power outlets 38 are disposed along the long front side surface 18 of the housing 12 of the power device 10. Between the first and second positions, the protrusions 64 engage the ends of 54 the casing 50 to provide a resistance force. As illustrated in FIG. 6, a spring arm 70 may be secured to the housing 12 to provide additional friction on the rotary socket element 56 when rotating the rotating outlet unit 30.

In certain embodiments, a method of providing power to an electronic device (not shown) includes providing a power device, such as power device 10, having a rotating outlet unit 30 capable of positioning the power outlets 38 along the top surface 14 or the side surface 18 of the housing 12, and rotating the rotating outlet unit to one of the first position and the second position to locate the plurality of outlets on a desired side of the housing. When rotating the rotating outlet unit 30 to the desired side of the housing 12, the protrusions 64 are positioned so that they are seated in the dimples 66.

Embodiments of the power device may include configuring the power device to include any number of power outlets oriented in a desired manner. In another embodiment, the power device may include a second rotating outlet unit provided along the opposite side of the first rotating outlet unit. With this embodiment, the power outlets may be provided along three sides of the housing of the power device. In yet another embodiment, the rotating outlet unit (or units) may be provided at an end (or ends) of the housing of the power device. In another embodiment, the rotary socket element may be provided on only one end of the casing and a simple pin and socket, for example, may be provided on the other end of the casing.

In other embodiments, the power device may include a power strip, or a surge protector, or a power condition or a battery. The principles taught herein may be directed to any type of device providing a power outlet.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

The invention claimed is:

1. A power device comprising:

a housing;

a power input interface to the housing; and a rotating outlet unit coupled to the housing, the rotating outlet unit having a plurality of power outlets to distribute power from the power input, the rotating outlet unit being configured to rotate between a first position in which the power outlets are disposed on one side of the housing and a second position in which the power outlets are disposed on another side of the housing, the rotating outlet unit including a casing and a rotary socket element provided at one end of the casing, the rotary socket element being fixed with respect to the casing and rotatably coupled to the housing to enable rotation of the casing with respect to the housing, wherein the housing and the casing include at least one protrusion provided on one of the housing and the casing and at least two dimples provided on the other of the housing and the casing, the at least one protrusion being configured to be seated in one of the at least two dimples when positioned in the first and second positions.

2. The power device of claim 1, wherein the casing includes a surface having the plurality of power outlets, the surface being co-planar with the sides of the housing when configuring the rotating outlet unit in the first position and the second position.

3. The power device of claim 2, wherein the plurality of outlets when located in the second position are disposed perpendicular to the plurality of outlets in the first position.

4. The power device of claim 1, wherein the rotary socket element includes a hollow interior to enable cables to pass from the housing to the casing of the rotating outlet unit.

5. The power device of claim 1, wherein the housing and the casing include several protrusions and dimples that are symmetrically positioned on their respective housing and casing.

6. The power device of claim 1, wherein the power device is a surge protector.

7. The power device of claim 1, wherein the power device is a power conditioner.

8. The power device of claim 1, wherein the power device is a power strip.

9. The power device of claim 1, wherein power device further includes a battery.

10. A method of providing power to an electronic device, the method comprising:

providing a power device including a housing, a power input interface to the housing, and a rotating outlet unit coupled to the housing, the rotating outlet unit having a plurality of power outlets to distribute power from the power input, the rotating outlet unit being configured to rotate between a first position in which the power outlets are disposed on one side of the housing and a second position in which the power outlets are disposed on another side of the housing;

rotating the rotating outlet unit to one of the first position and the second position to locate the plurality of outlets on a desired side of the housing; and positioning at least one protrusion provided on one of the housing and the rotating outlet unit into one of at least two dimples provided on the other of the housing and the rotating outlet unit, the at least one dimple being configured to be seated in one of the at least two dimples when rotated between the first and second positions.

11. The method of claim 10, wherein the rotating outlet unit includes a surface having the plurality of power outlets, the surface being co-planar with the sides of the housing when positioning the rotating outlet unit in the first position and the second position.

12. The method of claim 11, wherein the plurality of outlets in the second position are disposed perpendicular to the plurality of outlets in the first position.

13. The method of claim 10, wherein the power device is a surge protector.

14. The method of claim 10, wherein the power device is a power conditioner.

15. The method of claim 10, wherein the power device is a power strip.

16. The method of claim 10, wherein power device further includes a battery.

* * * * *